US011878342B1

(12) United States Patent
Sun et al.

(10) Patent No.: US 11,878,342 B1
(45) Date of Patent: Jan. 23, 2024

(54) VACUUM SMELTING DEVICE WITH MOLD TEMPERATURE CONTROL DESIGN AND METHOD FOR MANUFACTURING A TITANIUM-ALUMINUM INTERMETALLIC ALLOY

(71) Applicant: METAL INDUSTRIES RESEARCH & DEVELOPMENT CENTRE, Kaohsiung (TW)

(72) Inventors: Hong-Yuan Sun, Kaohsiung (TW); Chen-Hsueh Chiang, Kaohsiung (TW)

(73) Assignee: METAL INDUSTRIES RESEARCH & DEVELOPMENT CENTRE, Kaohsiung (TW)

( * ) Notice: Subject to any disclaimer, the term of this patent is extended or adjusted under 35 U.S.C. 154(b) by 0 days.

(21) Appl. No.: 18/075,098

(22) Filed: Dec. 5, 2022

(51) Int. Cl.

| | |
|---|---|
| ***B22D 18/08*** | (2006.01) |
| ***B22D 18/06*** | (2006.01) |
| ***B22D 21/02*** | (2006.01) |
| ***B22D 41/015*** | (2006.01) |
| ***C22C 1/02*** | (2006.01) |
| ***C22C 14/00*** | (2006.01) |
| ***B22D 7/00*** | (2006.01) |

(52) U.S. Cl.
CPC ..... *B22D 18/08* (2013.01); *B22D 7/005* (2013.01); *B22D 18/06* (2013.01); *B22D 21/022* (2013.01); *B22D 41/015* (2013.01); *C22C 1/02* (2013.01); *C22C 14/00* (2013.01)

(58) Field of Classification Search
CPC ..... B22D 18/08; B22D 18/06; B22D 7/005; B22D 21/022; B22D 41/015
See application file for complete search history.

(56) References Cited

U.S. PATENT DOCUMENTS 2,806,271 A * 9/1957 Operhall ..... B22D 18/06 164/24

FOREIGN PATENT DOCUMENTS

CN 101235450 A 8/2008

* cited by examiner

*Primary Examiner* — Kevin P Kerns
*Assistant Examiner* — Steven S Ha
(74) *Attorney, Agent, or Firm* — Juan Carlos A. Marquez; Marquez IP Law Office, PLLC

(57) ABSTRACT

A vacuum smelting device with mold-temperature control design includes: a chamber body and a cabin door, wherein the chamber body and the cabin door form a vacuum closed space; a smelting crucible disposed in the vacuum closed space for smelting raw materials to a molten metal; a casting mold also disposed in the vacuum closed space for accommodating the molten metal poured from the smelting crucible, and solidifying the molten metal to an as-cast alloy; and a mold-temperature control module surrounding the casting mold for controlling the temperature of the casting mold.

7 Claims, 6 Drawing Sheets

VACUUM SMELTING DEVICE WITH MOLD TEMPERATURE CONTROL DESIGN AND METHOD FOR MANUFACTURING A TITANIUM-ALUMINUM INTERMETALLIC ALLOY

BACKGROUND

Technical Field

The present disclosure relates to a vacuum smelting device, and in particular, to a vacuum smelting device with mold temperature control design and a method for manufacturing a titanium-aluminium intermetallic alloy.

Related Art

Compared with other intermetallic alloys, a titanium-aluminum (Ti—Al) intermetallic alloy has adequate comprehensive performance and has properties such as low density, high melting point, high oxidation resistance, and excellent high-temperature strength and rigidity. Moreover, the elastic modulus of the Ti—Al intermetallic alloy is much higher than that of other structural materials, and the Ti—Al intermetallic alloy used as a structural workpiece can significantly improve tolerance to high-frequency vibration. Compared with a nickel (Ni)-based alloy, the Ti—Al intermetallic alloy further has better high-temperature creep resistance and good flame-retardant performance.

Ti—Al intermetallic alloys can be improved currently through alloy composition design or mold temperature to enhance the casting properties of Ti—Al intermetallic alloys and reduce the defect generation; therefore, cast forming is deemed to be the most cost-effective Ti—Al intermetallic alloys process for product production. To enhance the properties of Ti—Al intermetallic alloys, typically a variety of different alloy elements are added, such as Nb, Cr, Mo, Mn, and W. etc. These elements will lead to change of the alloy phase diagram, for example, β-stable element (e.g., Nb, Cr, etc.) will enlarge the β-phase region. Studies indicated that adding niobium element can enhance the mechanical properties and high temperature resistance significantly. However, niobium element will cause segregation due to high melting point, and thus result in uneven alloy composition. Based on above factors, adding multiple elements will affect cast forming, so that change of phase diagram occurs during solidification due to different compositions or different cooling modes of metallic fluid. Nevertheless, phase composition, micro-segregation and grain size are key factors affecting cast structure of Ti—Al intermetallic alloys.

The patent document (CN101235450A) discloses a preparation method of a nickel-aluminium-vanadium alloy. It is to add metal element vanadium on the basis of nickel-aluminium alloy to obtain a high-temperature-resistant nickel-aluminium-vanadium alloy, so as to greatly improve the mechanical properties, hardness, strength, toughness and plasticity of alloy. The preparation method includes steps of precising raw material ratio; selecting chemical substances; pre-cuting and crushing; cleaning a melting furnace, a melting crucible and a casting mold; vacuuming extraction; inputting argon; argon blowing and stirring; cooling by water return; high-temperature smelting; casting; preparing nickel-aluminium-vanadium alloy ingots; finishing the ingot surface; processing in an aging treatment under high temperature, vacuum, and argon protection; and finally obtaining nickel-aluminium-vanadium alloy products. The melting temperature is 1900° C., and the aging temperature is 750° C., the aging time is 1100 hours, the prepared nickel-aluminium-vanadium alloy has stable mechanical properties, the high temperature resistance melting point can reach 1394° C., the hardness can reach HV590, the yield strength can reach 910 MPa, the tensile strength can reach 1102 MPa, and the elongation rate can be increased by 50%, and the impact toughness can be increased by 43%. However, the casting molds mentioned of the vacuum melting furnaces in the above-mentioned patent documents for preparing nickel-aluminium-vanadium alloy do not include a mold temperature control design for increasing the as-cast grain size.

Therefore, a vacuum smelting device with mold temperature control design is required to resolve the foregoing problems.

SUMMARY

An objective of the present disclosure is to provide a vacuum smelting device with mold temperature control design, which can maintain mold temperature.

According to the above objective, the present disclosure provides a vacuum smelting device with mold-temperature control design includes: a chamber body and a cabin door, wherein the chamber body and the cabin door form a vacuum closed space; a smelting crucible disposed in the vacuum closed space for smelting raw materials to a molten metal; a casting mold also disposed in the vacuum closed space for accommodating the molten metal poured from the smelting crucible, and solidifying the molten metal to an as-cast alloy; and a mold-temperature control module surrounding the casting mold for controlling the temperature of the casting mold.

The present disclosure further provides A method of manufacturing a Ti—Al intermetallic alloy comprising the following steps of: a smelting step: placing a plurality of raw materials of the Ti—Al intermetallic alloy in a vacuum smelting device according to claim 1, and melting the raw materials to a molten metal soup of the Ti—Al intermetallic alloy in the closed vacuum space; and a casting step: controlling the temperature of the casting mold in the same closed vacuum space, pouring the molten metal soup of the Ti—Al intermetallic alloy into the casting mold, and solidifying the molten metal soup to an as-cast alloy.

The vacuum smelting device with mold temperature control design of the present application has the following advantages: First, the mold temperature control module designed in the chamber body can make the process link, without manual movement and waiting for vacuuming time, greatly improving production efficiency. Second, it can maintain the mold temperature, avoid the heat loss of the casting mold, and achieve higher quality titanium-aluminium intermetallic alloy products. Third, different as-cast alloy components produce different temperatures of target structure. The vacuum melting device with mold temperature control design of the present application can control the temperature of the casting mold more accurate, and can make the structure more uniform and reduce the number of subsequent heat treatment processes.

DETAILED DESCRIPTION

In order to make the above or other objectives, features, and characteristics of the present disclosure more obvious and understandable, the relevant embodiments of the present disclosure are described in detail as follows with reference to the drawings.

The embodiments of the present disclosure are described in detail below in conjunction with the drawings. The attached drawings are mainly simplified schematic diagrams, which only schematically illustrate the basic structure of the present disclosure. Therefore, only components related to the present disclosure are marked in these drawings, and the displayed components are not drawn according to the number, shape, size ratio, etc. of the actual implementation. The actual size of the actual implementation is a selective design, and the layout of the components may be more complicated.

Figure 1:
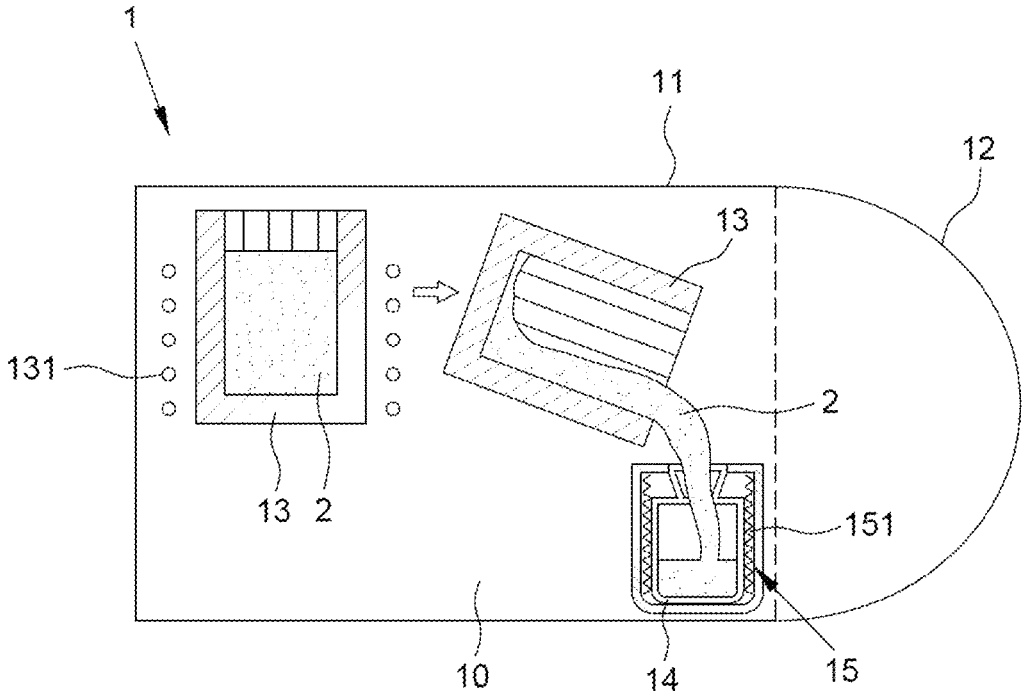
FIG. 1 is a schematic diagram showing a structure of a vacuum smelting device with mold temperature control design according to an embodiment of the present disclosure.

FIG. 1 is a schematic diagram showing a structure of a vacuum smelting device with mold temperature control design according to an embodiment of the present disclosure. Referring to FIG. 1, the vacuum smelting device 1 (with mold temperature control design), e.g., induction skull melting (ISM) device, mainly includes a chamber body 11, a cabin door 12, a smelting crucible (e.g., water-cooled copper crucible 13), a casting mold 14 and a mold temperature control module 15. The space defined by the chamber body 11 and the cabin door 12 can form a closed vacuum space 10. For example, the closed vacuum space 10 is formed by a vacuum pump (not shown). The water-cooled copper crucible 13 and the casting mold 14 are both disposed in the closed vacuum space 10. The water-cooled copper crucible 13 includes an electromagnetic induction heater 131 for melting a plurality of raw materials to a molten metal soup 2. The casting mold 14 is used to accommodate the molten metal soup 2 from the water-cooled copper crucible 13, and solidify into an as-cast alloy. The mold temperature control module 15 surrounds the casting mold 14, and includes a resistance heater 151 for increasing the temperature of the casting mold 14. The mold temperature control module 15 further includes a temperature sensor (not shown), a cooler (not shown) and a controller (not shown), etc., for controlling the temperature of the casting mold 14. The casting mold 14 can be a ceramic mold, a metal mold, a graphite mold or a sand mold. For example, the ceramic mold can be made of ceramic material of silicon oxide, aluminum oxide or zirconium oxide.

Figure 2:
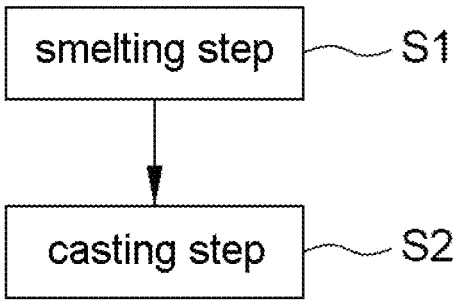
FIG. 2 is a flowchart of a method of manufacturing a titanium-aluminum intermetallic alloy according to an embodiment of the present disclosure.

FIG. 2 is a flowchart of a method of manufacturing a titanium-aluminum intermetallic alloy (Ti—Al intermetallic alloy) according to an embodiment of the present disclosure. The method of manufacturing a titanium-aluminum intermetallic alloy in the present disclosure mainly includes the following steps: (1) smelting step S1: a plurality of raw materials of a Ti—Al intermetallic alloy in a vacuum smelting device are placed, and the raw materials to a molten metal soup 2 of the Ti—Al intermetallic alloy are melted in the closed vacuum space; and (2) casting step S2: the temperature of the casting mold 14 is controlled in the same closed vacuum space 10, the molten metal soup 2 of Ti—Al intermetallic alloy is poured into the casting mold 14, and the molten metal soup 2 is solidified to an as-cast alloy. In this embodiment, when the as-cast alloy is a Ti—Al intermetallic as-cast alloy and the casting mold 14 is a ceramic mold, the mold temperature control module 15 controls the temperature of the ceramic mold between 1100±200° C. (i.e., the temperature of the ceramic mold is controlled between 900 and 1300° C.), and the temperature holding time is: 2-4 hours, whereby the overall grain size of the Ti—Al intermetallic as-cast alloy is between 200 μm and 300 μm.

For example, the as-cast alloy of the present disclosure is the Ti—Al intermetallic as-cast alloy, and the alloy composition in the as-cast alloy is Ti-48Al-3Cr-3Nb (at %), which has well fluidity. The raw materials of the as-cast alloy comprise pure titanium of Gr.1 (99.96 wt %), aluminum-niobium (niobium content: 60 wt), pure chromium (99.9 wt %) and pure aluminum (99.999 wt %). The raw materials of the as-cast alloy are smelted in the water-cooled copper crucible of the vacuum smelting device shown in FIG. 1. Vacuum in the chamber body is evacuated to $10^{-3}$ torr, and then filled with argon atmosphere to about 400 mbar. Prior to smelting of the raw material of the as-cast alloy, the casting mold will be heated to specific temperature in the vacuum smelting device. As the water-cooled copper crucible is at 1554° C., the molten metal soup of Ti—Al intermetallic alloy of the present disclosure is poured into the ceramic mold and metal mold with the grouting surface of stabilized-$ZrO_2$ under different mold temperature (1100° C., 850° C., 650° C., 500° C.). The heating of the casting mold is stopped after completion of pouring, while the cooling within the chamber body is conducted until the ceramic mold with Ti—Al intermetallic casting ingot (i.e., as-cast alloy) is taken out at room temperature.

Figure 3:
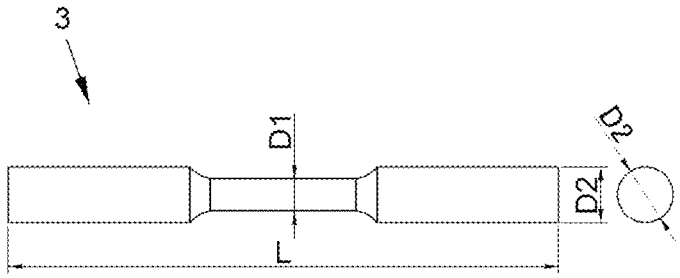
FIG. 3 shows the dimension of a tensile test bar of the Ti—Al intermetallic casting ingot of the present disclosure.

After the casting ingot is taken out from the casting mold, the casting ingot will be processed to become tensile test bar and specimen for microstructure observation. FIG. 3 shows the dimension of a tensile test bar of the Ti—Al intermetallic casting ingot of the present disclosure. Referring to FIG. 3, the casting ingot is processed to the tensile test bar with the dimension of length L1: 195 mm, diameter D1: 15.5 mm and diameter D2: 20 mm. The casting ingot taken out from the ceramic mold to be processed to specimens with the cross section of 8 mm*8 mm is referred as C—TiAl; and the casting ingot taken out from the metal mold to be processed to specimens with the cross section of 20 mm*20 mm is referred as M-TiAl. Its phase composition can be appraised by X-ray diffraction and chemical composition is inspected through inductive coupling plasma analysis (ICP) as shown in Table 1; meanwhile, metallographic observation on cast structure is also performed. The etchant includes 1 ml of hydrofluoric acid, 4 ml of nitric acid and 45 ml of water.

After etching, observation for microstructure is performed on optical microscope and electronic microscope.

TABLE 1

Chemical composition of Ti-48Al-3Cr-3Nb intermetallic alloy as follows:

| Alloys | Ti | Al | Nb | Cr |
|---|---|---|---|---|
| Mental molds | Bal. | 31.42 ± 0.18 | 6.65 ± 0.16 | 3.88 ± 0.22 |
| Ceramic molds | Bal. | 32.59 ± 0.22 | 6.78 ± 0.12 | 3.68 ± 0.28 |

Figure 4:
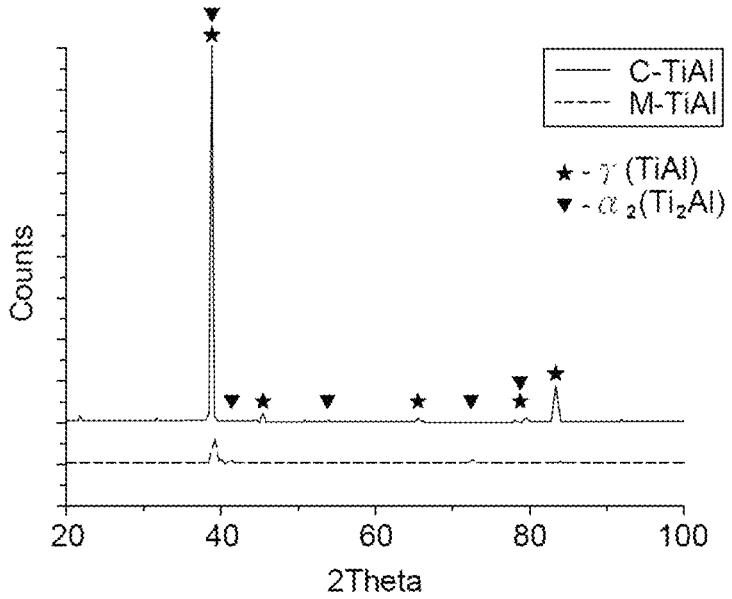
FIG. 4 shows X-ray diffraction diagram (C-TiA and M-TiAl) of the present disclosure.

FIG. 4 shows X-ray diffraction diagram (C-TiA and M-TiAl) of the present disclosure. Referring to FIG. 4, as displayed in the X-ray diffraction diagram, γ-TiAl phase has the highest diffraction peak and accounts for the majority, which is thus the main phase. $\alpha_2$-Ti3Al phase also occupies partial peak positions. It is the main phase as well, but its quantity is less than γ-TiAl phase which is due to the phase transformation energy difference of thermodynamics and dynamics. Transformation of nucleation growth $\alpha \rightarrow \gamma$ is easier than the ordered transformation $\alpha \rightarrow \alpha_2$. Therefore, eutectoid reaction of $\alpha \rightarrow \alpha_2 + \gamma$ hardly occurs. Actually, $\alpha \rightarrow \gamma$ occurs more easily which leads to the result of highest diffraction peak value of γ-TiAl phase and large quantity. Meanwhile, the main diffraction peak of C—TiAl is higher than the diffraction strength of M-TiAl and its half-height of diffraction peak is narrower which indicates the better crystallization of C—TiAl.

Figure 5:
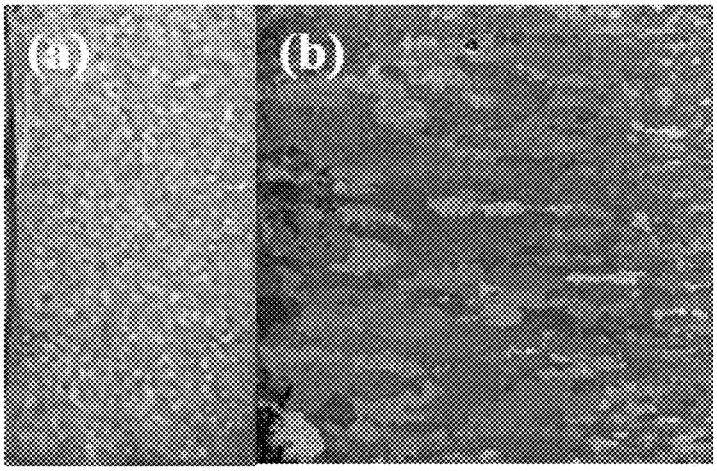
FIG. 5 shows the specimen surface topographies of the present disclosure: (a) C—TiAl (b) M-TiAl after etching.

FIG. 5 shows the specimen surface topographies of the present disclosure: (a) C—TiAl (b) M-TiAl after etching. Referring to (a) C—TiAl of FIG. 5, it can be found by visual observation that the structure of etched C—TiAl looks to be an equiaxed grain structure, and (b) M-TiAl of FIG. 5 presents columnar structure. Since the cooling speed of metal mold is faster, it causes grain growth direction opposed to heat convection direction and thus leads to the most advantageous directed growth of grains. Most cast structure is therefore columnar grain structure. On the other hand, more equiaxed crystals of castings are expected from ceramic mold with its relatively better heat insulation and operated in a vacuum smelting device.

Figure 6:
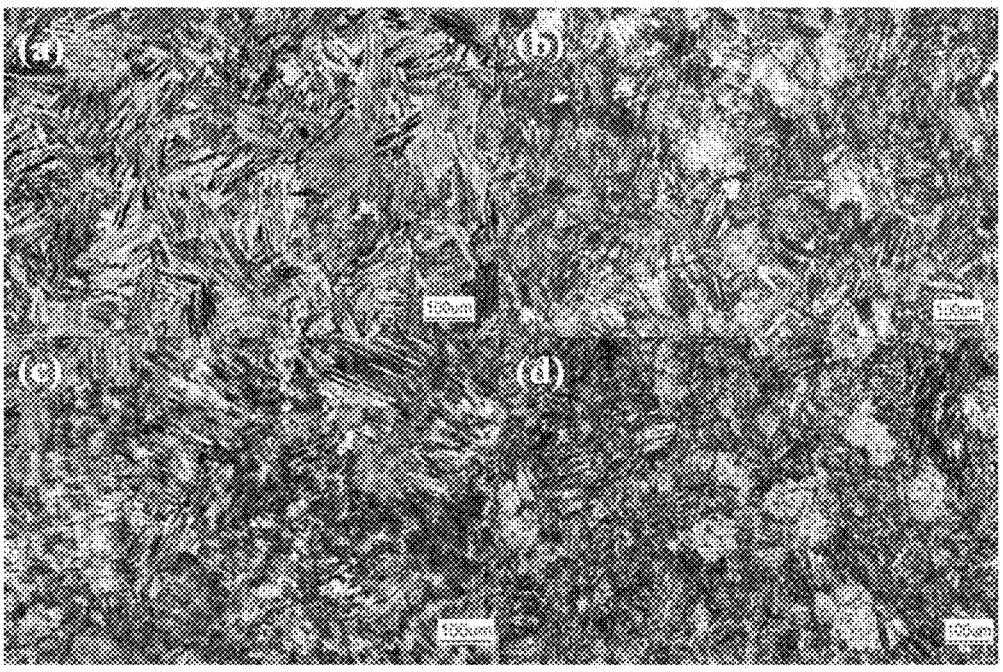
FIG. 6 shows OM images of as-cast alloy of C—TiAl of the present disclosure: (a) 1100° C. (b) 850° C. (c) 650° C. (d) 500° C.
Figure 7:
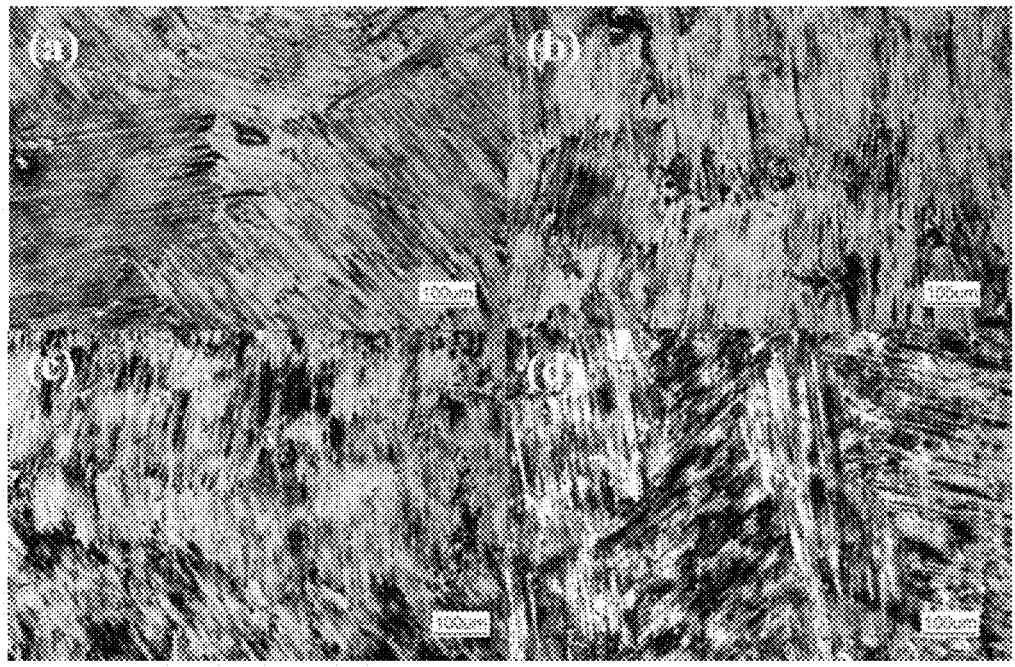
FIG. 7 shows OM images of as-cast alloy of M-TiAl of the present disclosure: (a) 1100° C. (b) 850° C. (c) 650° C. (d) 500° C.
Figure 8:
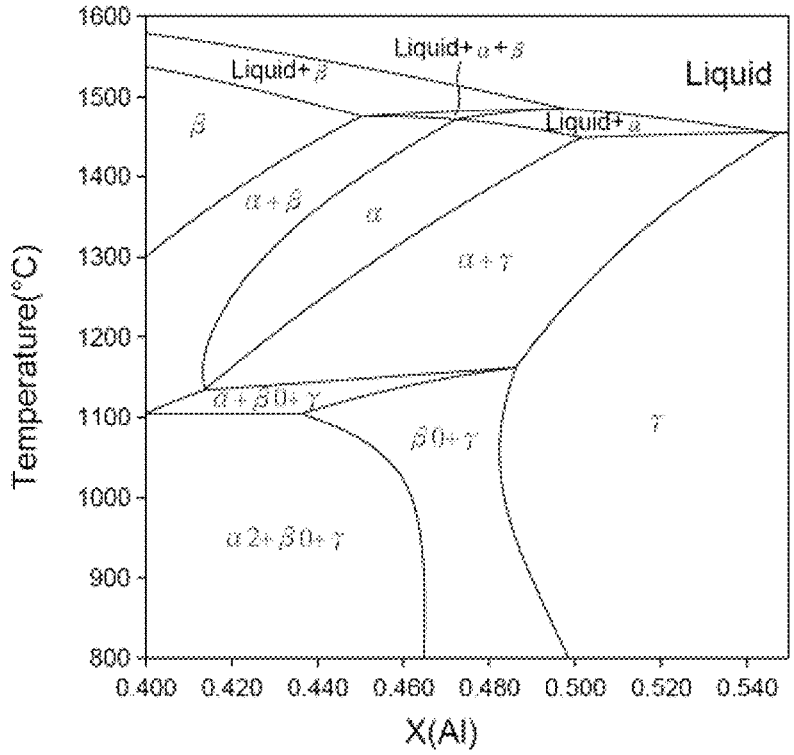
FIG. 8 shows a phase diagram of the Ti-xAl-xCr-xNb (in at %).
Figure 9:
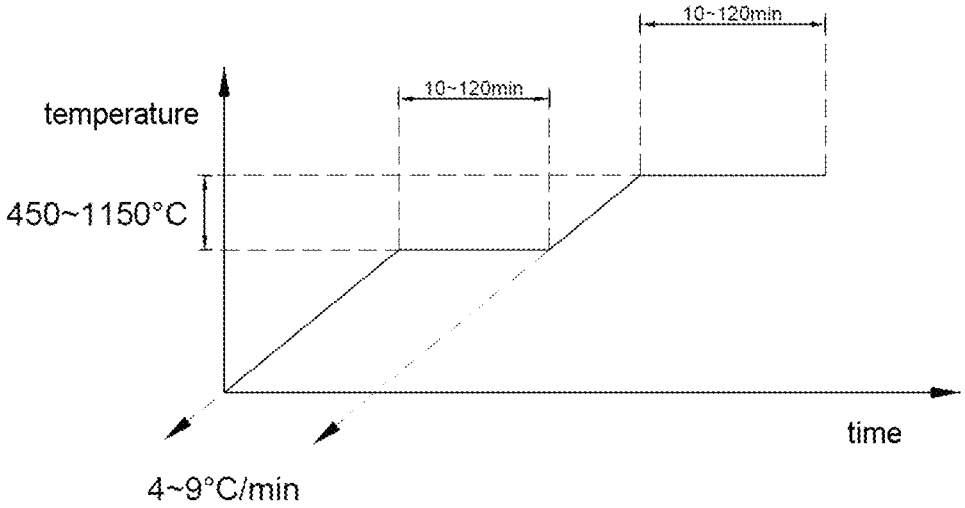
FIG. 9 shows the mold heating curve according to an embodiment of the present disclosure.

FIG. 6 shows OM images of as-cast alloy of C—TiAl of the present disclosure: (a) 1100° C. (b) 850° C. (c) 650° C. (d) 500° C. FIG. 7 shows OM images of as-cast alloy of M-TiAl of the present disclosure: (a) 1100° C. (b) 850° C. (c) 650° C. (d) 500° C. Referring to FIG. 6 and FIG. 7, it is found that C—TiAl and M-TiAl cast alloys show fully lamellar microstructure (FL) through observation by optical microscope (OM), and it looks clearly that the crystallization of C—TiAl is better than M-TiAl which proves the effect of X-ray inspection. Additionally, since the ceramic mold has better heat preservation, the cooling speed of metallic fluid is thus slower in the ceramic mold, which makes the interlamellar spacing of C—TiAl to be bigger than that of M-TiAl. Although finer interlamellar structure (shown in FIG. 7) is achieved with M-TiAl, since columnar crystal structure has negative effect on the overall mechanical properties of material, besides, casting for products with complicated shape is necessary in the future, the metal mold is not suitable for this reason. Therefore, further analysis for the cast structure of C—TiAl will be made. FIG. 6(*a*) presents the cast structure of C—TiAl poured at 1100° C. It is found that its lamellar structure is rougher, and its grain is more obvious compared to the cast structure of C—TiAl poured at other three temperatures (850° C., 650° C. and 500° C., shown in FIG. 6(*b*), FIG. 6(*c*), and FIG. 6(*d*)). This is because the molten metal soup of Ti—Al intermetallic alloy in the shell with higher temperature (1100° C.) is going through the crystallization process of nucleation growth, after then, elements with higher atomic weight (Nb, Cr) has more sufficient energy to diffuse during phase transition in the high temperature environment, so that its balance of solidification is more complete, but its growth of grains is relatively easier. When pouring is performed in the ceramic mold at lower temperature (850° C., 650° C. and 500° C.), the cooling speed is faster due to large temperature difference, so that elements are hard to achieve balance status, incomplete phase transition is thus resulted and causes serious segregation in the cast structure where its lamellar structure is less favorable for observation. The overall grain size looks also smaller due to lower environmental temperature, shown in FIG. 6(*b*), FIG. 6(*c*), and FIG. 6(*d*). Accordingly, the temperature of the casting mold (e.g., the ceramic mold) is controlled between 1100±200° C., and the temperature holding time is: 2-4 hours, whereby the overall grain size of the Ti—Al intermetallic as-cast alloy is bigger (i.e., the overall grain size is between 200 μm and 300 μm). It means that the atomic diffusion is more completely inclined to equilibrium solidification, and the temperature of the casting mold is controlled in accordance with the α+γ temperature range of Ti—Al intermetallic alloy (as shown in FIG. 8). Subsequently, it can reduce the time of heat treatment and homogenization, and facilitate the acquisition of target structure. In addition, if the temperature of the casting mold is too low, it will have an adverse effect on the fluidity of the molten metal soup, and has caused segregation problems; and if the temperature of the casting mold is too high, the casting mold will not be able to withstand the high temperature and cause cracks, such as the upper limit of temperature to heat the ceramic mold is 1450° C. (Max.) to avoid cracking of the ceramic mold. Furthermore, the excessive heating rate of the casting mold may cause the casting mold to break. FIG. 9 shows the mold heating curve according to an embodiment of the present disclosure. Referring to FIG. 9, it shows the heating curve of the ceramic mold. The mold temperature control module controls the temperature increasing rate of the ceramic mold between: 4° C./min and 9° C./min to avoid the ceramic mold from breaking.

Figure 10:
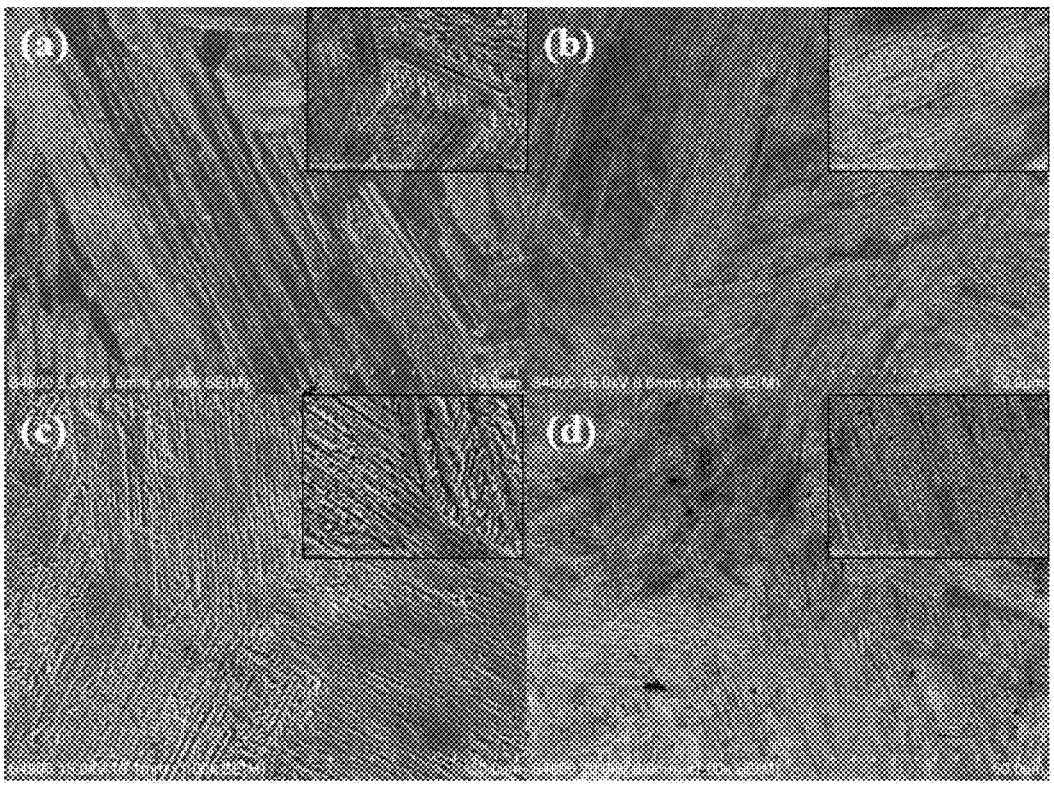
FIG. 10 shows SEM images of as-cast alloy of C—TiAl of the present disclosure: (a) 1100° C. (b) 850° C. (c) 650° C. (d) 500° C.

FIG. 10 shows SEM images of as-cast alloy of C—TiAl of the present disclosure: (a) 1100° C. (b) 850° C. (c) 650° C. (d) 500° C. Referring to FIG. 10, it proves by the analysis with scanning electronic microscope (SEM) again that the cast structures of C—TiAl are all fully lamellar structure. Furthermore, by increasing the magnification for observation, the molten metal soup of Ti—Al intermetallic alloy in the ceramic mold at 1100° C. easily induces the roughing of the interlamellar spacing in the structure. However, its lamellar structure is more complete and presents long strip shape, shown in FIG. 10(*a*). The lower the temperature of the ceramic mold along with pouring, the faster is the cooling speed. Atomic diffusion of the solute (in matrix) is easily depressed. The forming of secondary phase is incomplete and tends to be unbalanced setting process which results in implicit long-strip-shaped lamellar structure and zigzag-shaped lamellar structure; besides, the width of lamellar structure becomes finer, shown in FIG. 10(*b*)-(*d*). The composition of this alloy is α-phase solidification. According to the crystallization relationship by Blackburn, the final lamellar structure and growth direction in the alloy will be (0001) α//(111)γ in vertical orientation. Table 2 shows the mechanical property results of the tensile bar for different ceramic mold temperatures. No yield phase occurs during stretching at room temperature for all four ceramic mold temperatures, while the elongation rate is very low and it is a brittle fracture and the tensile strength is 380-413 MPa, where the strength of C—TiAl of the ceramic mold at 1100° C. is the lowest due to coarse structure.

TABLE 2

Tensile results of as-cast C—TiAl (a) 1100° C. (b) 850° C. (c) 650° C. (d) 500° C. as follows:

| Ceramic mold's temperature(° C.) | UTS(MPa) | elongation(%) |
|---|---|---|
| 1100 | 380 | 0.38 |
| 850 | 391 | 0.35 |
| 650 | 400 | 0.32 |
| 500 | 413 | 0.36 |

In this study of the present disclosure, Ti-48Al-3Cr-3Nb intermetallic alloy is poured in the metal mold and ceramic mold at different temperatures (1100° C., 850° C., 650° C. and 500° C.), and its change of cast structure and strength after solidification is observed to obtain the following conclusion:

First, the microstructures of the casting part of the Ti-48Al-3Cr-3Nb intermetallic alloy cast by the vacuum smelting device are all fully lamellar structure whose phase is mainly γ-TiAl phase and $\alpha_2$-Ti3Al phase.

Second, the cast structure of the casting part from the metal mold is mostly columnar crystal, but its lamellar structure is finer; and the cast structure of the casting part from the ceramic mold is mostly cubic crystal with better crystallization, but its lamellar structure is coarser.

Third, the elongation of the cast structure of the casting part from the ceramic mold is very low at room temperature. It needs improvement with subsequent heat treatment, where the crystallization of C—TiAl at 1100° C. is the best. This indicates that the atomic diffusion tends to be balanced solidification more completely and there are opportunities to reduce the processing time for homogenization with heat treatment, and the temperature of the casting mold is controlled in accordance with the α+γ temperature range of Ti—Al intermetallic alloy. Subsequently, it can reduce the time of heat treatment and homogenization, and facilitate the acquisition of target structure.

Fourth, when pouring is performed in the ceramic mold at lower temperature (1100° C.), elements with higher atomic weight (Nb, Cr) in the molten metal soup has more sufficient energy to diffuse during phase transition in the high temperature environment, so that its balance of solidification is more complete, and the organization is also more uniform. When pouring is performed in the ceramic mold at lower temperature (850° C., 650° C. and 500° C.), the cooling speed is faster due to large temperature difference, so that elements are hard to achieve balance status, incomplete phase transition is thus resulted and causes serious segregation in the cast structure where its lamellar structure is less favorable for observation, and the organization is not uniform.

The vacuum smelting device with mold temperature control design of the present application has the following advantages: First, the mold temperature control module designed in the chamber body can make the process link, without manual movement and waiting for vacuuming time, greatly improving production efficiency. Second, it can maintain the mold temperature, avoid the heat loss of the casting mold, and achieve higher quality titanium-aluminium intermetallic alloy products. Third, different as-cast alloy components produce different temperatures of target structure. The vacuum melting device with mold temperature control design of the present application can control the temperature of the casting mold more accurate, and can make the structure more uniform and reduce the number of subsequent heat treatment processes.

Based on the above, only the preferred implementations or embodiments of the technical means adopted by the present disclosure for solving the problems are described, and are not intended to limit the scope of patent implementation of the present disclosure. That is, all equivalent changes and modifications made in accordance with the scope of the patent operation of the present disclosure or made in accordance with the scope of the patent of the present disclosure fall within the scope of the patent of the present disclosure.

What is claimed is:

1. A method of manufacturing a Ti—Al intermetallic alloy comprising the following steps of:

providing a vacuum smelting device, wherein the vacuum smelting device comprises:

a chamber body and a cabin door, wherein the chamber body and the cabin door form a vacuum closed space;

a smelting crucible disposed in the vacuum closed space;

a casting mold also disposed in the vacuum closed space; and a mold-temperature control module surrounding the casting mold;

placing a plurality of raw materials of the Ti—Al intermetallic alloy in the vacuum smelting device, and melting the plurality of raw materials to a molten metal soup of the Ti—Al intermetallic alloy in the closed vacuum space; and controlling the temperature of the casting mold in the same closed vacuum space, pouring the molten metal soup of the Ti—Al intermetallic alloy into the casting mold, and solidifying the molten metal soup to an as-cast alloy;

wherein when the as-cast alloy is a Ti—Al intermetallic as-cast alloy and the casting mold is a ceramic mold, the mold temperature control module controls the temperature of the ceramic mold between 1300° C. and 900° C., and the temperature holding time is: 2-4 hours.

2. The method of manufacturing the Ti—Al intermetallic alloy according to claim 1, wherein an overall grain size of the Ti—Al intermetallic as-cast alloy is between 200 μm and 300 μm.

3. The method of manufacturing the Ti—Al intermetallic alloy according to claim 1, wherein the Ti—Al intermetallic as-cast alloy has an equiaxed grain structure.

4. The method of manufacturing the Ti—Al intermetallic alloy according to claim 1, wherein the mold temperature control module controls a temperature increasing rate of the ceramic mold between: 4° C./min. and 9° C./min.

5. The method of manufacturing the Ti—Al intermetallic alloy according to claim 1, wherein the ceramic mold is made of ceramic material of silicon oxide, aluminum oxide or zirconium oxide.

6. The method of manufacturing the Ti—Al intermetallic alloy according to claim 1, wherein the mold temperature control module includes a resistance heater for increasing the temperature of the casting mold.

7. The method of manufacturing the Ti—Al intermetallic alloy according to claim 1, wherein the smelting crucible includes an electromagnetic induction heater for melting the plurality of raw materials to the molten metal soup.

* * * * *